United States Patent [19]

Fremstad

[11] Patent Number: 4,475,296

[45] Date of Patent: Oct. 9, 1984

[54] FILLET FOR PICTURE FRAME

[76] Inventor: Gregory E. Fremstad, 777 San Carrizo Way, Mountain View, Calif. 94043

[21] Appl. No.: 457,797

[22] Filed: Jan. 13, 1983

Related U.S. Application Data

[63] Continuation-in-part of Ser. No. 189,382, Sep. 22, 1980.

[30] Foreign Application Priority Data

Apr. 13, 1981 [CA] Canada ..... 375310

[51] Int. Cl.[3] ..... G09F 1/12

[52] U.S. Cl. ..... 40/152; 40/10 R; 52/788

[58] Field of Search ..... 40/152, 152.1, 155, 40/10 R, 160, 156; 52/788

[56] References Cited

U.S. PATENT DOCUMENTS

| | | | |
|---|---|---|---|
| 2,985,977 | 5/1961 | Roseman | 40/156 |
| 3,095,661 | 7/1963 | Ellis | 40/156 |
| 3,231,951 | 2/1966 | De Armond | 40/11 R |
| 3,981,091 | 9/1976 | Wiener | 40/156 |

FOREIGN PATENT DOCUMENTS

| | | | |
|---|---|---|---|
| 2640642 | 3/1978 | Fed. Rep. of Germany | 40/152 |

*Primary Examiner*—Gene Mancene

*Assistant Examiner*—Wenceslao J. Contreras

*Attorney, Agent, or Firm*—Townsend and Townsend

[57] ABSTRACT

A fillet for a use in holding a transparent sheet of glass or plastic spaced from artwork mounted in a picture frame. The fillet has a one-piece construction and is provided with a recess and a spacer portion. Preferably, the fillet has a generally S-shaped body defining two recesses of different widths with each recess being defined by an end wall and an intermediate wall, the intermediate wall being common to the two end walls. Each end wall is angled relative to the intermediate wall and the material of the fillet is resilient so that the end walls can yield away from the intermediate wall to accommodate glass or plastic sheets whose thicknesses are greater than the minimum widths of the recesses. The S-shaped fillet is reversible so that, in one position, it can receive a plastic glass sheet of a relatively small thickness in one of the recesses and, in the other position it can receive a glass or plastic sheet of relatively large thickness in the other recess. In either case, the glass or plastic sheet is effectively spaced by the fillet from the artwork to prevent engagement of the sheet and the artwork.

3 Claims, 8 Drawing Figures

FILLET FOR PICTURE FRAME

This is a continuation-in-part of U.S. application, Ser. No. 189,382, filed Sept. 22, 1980.

This invention relates to improvements in the mounting of artwork in a frame having a front glass or plastic sheet through which the artwork is viewed and, more particularly, to an improved fillet which forms a dual function of gripping the edge margin of the glass or plastic sheet and spacing the sheet a safe distance from the artwork.

BACKGROUND OF THE INVENTION

In mounting expensive artwork in frames, it is the normal procedure to mount a glass or plastic sheet or panel in front of the artwork to protect it against dust and moisture and other possibly damaging effects. It is also important to keep front sheet adequately spaced from the artwork so that there will be no engagement between the two which would cause structural damage to the artwork such as ink transfer, mold growth (foxing) and buckling. Preferably dust and dirt particles should be kept out of the space between the sheet and the artwork so that the artwork is effectively preserved for long periods of time and does not become discolored or otherwise affected by foreign particles in the space.

Attempts have been made in the past to use spacers to space the sheet from the artwork. Balsa wood, plastic and cardboard spacers have been used for this purpose. Such spacers have to be glued to the adjacent frame member. This technique is not satisfactory because the glue often becomes loose, the spacers buckle, and the artwork is not properly spaced from the glass or plastic front sheet when this occurs. Also, the materials now used as spacers may themselves cause damage to the artwork because of acid content or, if painted, paint transfer to the artwork.

Other attempts have included the use of a transversely C-shaped spacer which has been too small in thickness to space the artwork any more than 1/16 inch away from the sheet. This spacer presents too small a space between the front sheet and the artwork because 1/16 inch is an inadequate space for many embossed, thick or naturally wavy pieces of art.

The mounting of panels in frame members, such as window panes or the like, have been known in the past. Typical disclosures of concepts of this type are set forth in U.S. Pat. Nos. 2,126,167, 2,189,137 and 2,308,918.

Because of the limitations of spacer units for frames for artwork which have been heretofore used, a need has arisen for an improved spacer or fillet which effectively spaces the transparent sheet in the front of the artwork from the artwork itself while permitting easy assembly of the artwork and sheet into a frame without special skills and tools.

SUMMARY OF THE INVENTION

The present invention satisfies the aforesaid need by providing an improved fillet of resilient material for use with picture frames in which a transparent sheet of glass or plastic is mounted in front of and spaced from a sheet of artwork having a backing member adjacent thereto and coupled to the frame members of the frame. To this end, the fillet of this invention has an open-sided recess for receiving the adjacent marginal edge of the sheet of glass or plastic. The fillet grips onto this marginal edge and becomes releasably attached to it. The fillet also has a spacer portion extending transversely of the recess to increase the height of the fillet so that the fillet will form a space between the sheet of glass or plastic and the artwork when the fillet is in an operative position in a frame.

Preferably, the fillet is generally S-shaped in cross-section and is an extrusion which can be made of any length and cut to size for use with any particular picture frame. The S-shape permits the fillet to have two open-sided recesses instead of a single recess. The fillet is made of resilient material so that a pair of opposed end walls forming parts of the fillet can yield outwardly of an intermediate wall of the fillet to increase the widths of the open-sided recesses formed by the end and intermediate walls of the fillet. In the case of an S-shaped fillet, one recess is wider than the other recess to accommodate sheets of different thicknesses. The S-shaped fillet is therefore reversible in a frame so that, for a relatively thin sheet, one of the recesses is used; whereas, for a relatively thick sheet, the other recess is used. In either case, the part of the fillet forming the recess not in use defines the spacer portion of the fillet.

The fillet of the present invention, therefore, operates to space a glass or plastic front sheet an adequate distance from the artwork and to be self-retaining on the side margin of the sheet. Thus, the fillet will remain on the sheet during assembly of the artwork in a frame yet the fillet will substantially eliminate the possibility of ink transfer, mold growth and buckling of the artwork.

The primary object of this invention is to provide an improved fillet for use in simplifying the mounting of artwork in frames wherein the fillet has an open-sided recess and a spacer portion extending transversely of the recess to increase the height of the fillet so as to space a glass or plastic sheet an adequate distance from the artwork when the side margin of the sheet is received in the recess.

Another object of the present invention is to provide a frame for artwork using a fillet of the type described wherein the frame includes frame members against which sections of the fillet engage as the fillet sections receive and are releasably retained on the edge margins of a transparent sheet of glass or plastic in place across the front of the frame so that the fillet sections space the sheet from the artwork an adequate distance to protect the artwork.

Other objects of this invention will become apparent as the following specification progresses, reference being had to the accompanying drawings for an illustration of the invention.

Figure 1:
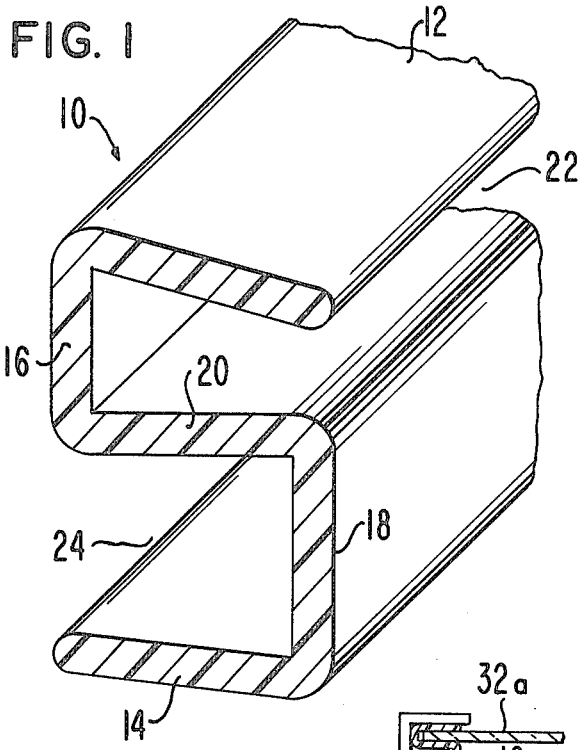
FIG. 1 is a perspective view of a section of one form of the fillet of this invention.
Figure 2:
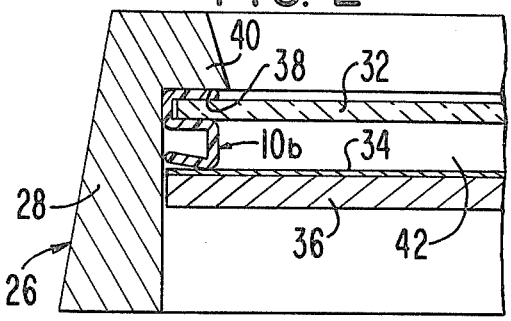
FIG. 2 is a cross-sectional view through a typical frame showing the fillet of FIG. 1 in use for spacing artwork from a glass or plastic sheet with the outer peripheral margin of the sheet being received in one of the two recesses of the fillet.
Figure 3:
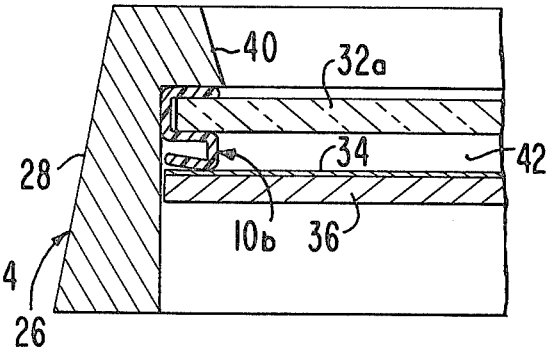
FIG. 3 is a view similar to FIG. 2 but showing the outer margin of the sheet received in the other recess of the fillet of FIG. 1 while the fillet spaces the sheet from the artwork.

The fillet of the present invention is broadly denoted by the numeral 10 and, in a preferred embodiment, has a cross section of the type shown in FIGS. 1–3. Fillet 10 includes a pair of spaced end walls 12 and 14, a pair of spaced sidewalls 16 and 18 connected to respective end walls 12 and 14, and an intermediate, connecting wall 20 interconnecting walls 6 and 18. Walls 12, 14, 16, 18 and 20 are preferably transparent, are integral with each other, and are formed from a suitable material which can be molded or extruded. A typical material is polyethylene or butyrate. Any suitable material can be used so long as the walls of fillet 10 are relatively rigid yet the fillet has resilience at least at the junctions of adjacent walls. Transparency of the fillet allows the color of artwork behind the fillet to be seen when the fillet is in use.

Typically, sidewalls 16 and 18 are parallel with each other but end walls 12 and 14 are not parallel. As shown in FIGS. 2 and 3, walls 12 and 14 are angularly disposed with reference to intermediate wall 20 when the fillet is not in use. Walls 12 and 14 form with wall 20 respective open-sided recesses 22 and 24 and the width of the side openings of the recesses are effectively adjustable by virtue of the resilience of fillet 10 at the junction between walls 12 and 16 and at the junction between walls 14 and 18. The purpose of this adjustability is to permit a particular end wall, such as end wall 12 to be biased toward and bear against a sheet of glass or plastic whose outer peripheral edge margin is inserted into the corresponding recess, such as recess 22. This effectively causes the fillet to be self-retaining on the sheet so that the fillet will not buckle along its length. This feature is of importance when assembling the sheet and the artwork in a frame.

Recess 22 has a width sufficient to receive glass or plastic sheets which are relatively thin. Recess 24, on the other hand, has a width sufficient to permit it to receive relatively thick glass or plastic sheets.

If recess 22 is used, the remainder of the fillet, i.e., the portion of the fillet forming recess 24 defines a spacer portion extending transversely of recess 22 to increase the height of the fillet. Conversely, if recess 24 is used, the portion of the fillet forming recess becomes the spacer portion. Such spacer portion could be solid if only one recess is to be provided on the fillet. Instead of being solid, this spacer portion could be a single leg, such as wall 18 with wall 14 being omitted. Thus, in a broad sense, the fillet of this invention includes a recess portion and a spacer portion.

In use, with a picture frame 26 having a pair of side frame members 28 and a pair of end frame members 30, fillet 10 is cut into four sections **10*a*, 10*b*, 10*c* and 10*d*. The fillet sections are shown in abutment with each other. They can be mitered, if desired. As shown at FIG. 2, fillet section 10*b* serves a dual function of receiving and being self-retaining on a glass or plastic sheet 32 and of spacing artwork 34 an adequate distance from sheet 32. One outer edge margin of sheet 32 is received in the corresponding recess 22 of fillet section 10*b*. Wall 12 of this fillet section is shown in surface-to-surface contact with the sheet but it could also be in line contact at the outer edge of the end wall if the thickness of the sheet is less than the maximum width of the recess. FIG. 2 shows that the opposite end wall 14 of fillet section 10*b* makes a slight angle with reference to the intermediate wall 20 of the fillet section. A backing panel 36 engages the rear surface of artwork 34 in the usual manner and brads or nails anchor the backing member 36** to the sides and ends of the frame.

Figure 4:
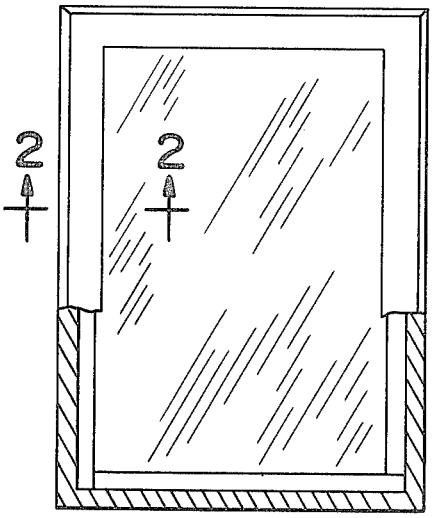
FIG. 4 is a front elevational view, partly in section of a complete frame showing the fillet of this invention in sections at the sides and end of the frame.

FIG. 4 shows the four fillet sections in place in a completed frame. When so completed, the fillet sections engage the inner surfaces 38 (FIG. 2) of the overhangs or rabbits 40 of the frame members 28 and 30. Moreover, the junctions between a pair of adjacent fillet sections (FIG. 4) can be coupled together for continuity purposes.

Assembling the fillet sections, the sheet, the artwork and the backing member 36 in the frame is a simple matter because these components can be formed in a sandwich and dropped simultaneously into the frame from the rear. Then the backing member is secured to the frame members in the usual manner to complete the assembly.

FIG. 3 shows a relatively thick sheet of glass or plastic **32*a* in place of relatively thin sheet 32 (FIG. 2). In such a case, the fillet sections are reversed so that the outer edge margins of sheet 32*a* are received in the corresponding recesses 24 of the fillet sections. Again, end walls 14 of the fillet sections yield slightly outwardly to receive the outer edge margins of the sheet, whereupon the end walls 14 can either be in line contact at their outer margins or can be in surface-to-surface contact with the sheet depending upon the thickness of the sheet. The assembly of the frame with the artwork is accomplished in the same way with sheet 32*a* as described above with respect to sheet 32**.

Figure 5:
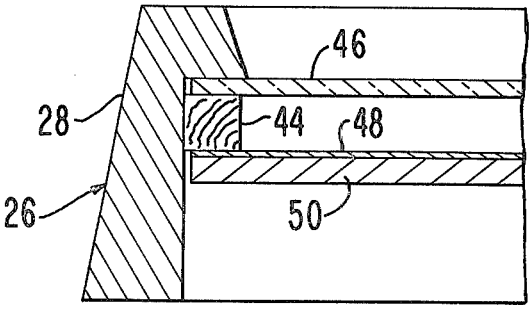
FIG. 5 PRIOR ART
FIGS. 5 and 6 are views similar to FIGS. 2 and 3 but illustrating prior art structure for spacing a glass sheet from artwork in a picture frame.

FIG. 5 shows one form of a prior art device typically used with frame 26. It comprises a balsa wood spacer or section 44 which usually is bonded to the adjacent frame member. Besides the acid content of the wood burning the adjacent artwork, the natural color of the wood makes it viewable through the glass sheet 46 so that the balsa wood should be painted to provide a professional look to the completed frame. This painting requires additional labor which is not essentially transparent so as not to be observable through the sheet 32. Also, painting will possibly result in some paint transfer to the artwork. Because the balsa wood is bonded by glue or adhesive to the frame, the glue can come loose and when this occurs, the balsa wood droops and requires replacement to provide the necessary support for artwork 48 and backing member 50.

Figure 6:
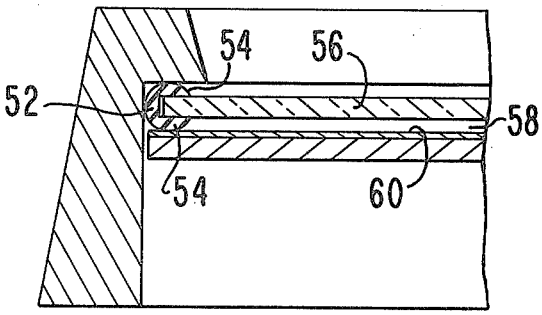
FIG. 6 PRIOR ART

Another form of prior art device is the transversely C-shaped extrusion 52 having spaced sides 54 as shown in FIG. 6. A primary limitation of extrusion 52 is that it permits only a 1/16 inch clearance 58 between sheet 56 and artwork 60. This is not enough clearance to prevent engagement of sheet 56 and artwork 60. This problem is avoided at all times by the relatively large space between the sheet and the artwork when using fillet 10. Also, extrusion 52 is designed primarily to protect sheet 56 from breakage. It is not designed for use as a fillet and, if so used, is not properly used.

Figure 7:
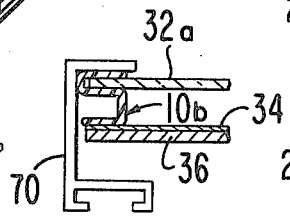
FIG. 7 is a fragmentary, cross-sectional view of a metal frame showing the fillet of FIG. 1 in position to space artwork from a glass or plastic sheet.

Another prior art frame is of one of the type made of metal frame members 70 having the cross section shown in FIG. 7. Fillet 10 can be used with this type of frame. Use of fillet 10 with this frame eliminates the tedious job of placing the fourth side on the frame when the sheet of glass or plastic, the artwork and the backing member are in the frame formed by the other three sides. The reason for this is that the spacers between the glass or plastic sheet and the artwork must be bonded by an adhesive to the inner surfaces of the sides. After connecting the three sides together, the sheet of glass or plastic must be slid in place between the rabbits on the frame sides and the spacers, a very tedious job since any excess adhesive in the groove receiving the marginal side edges of the sheet will inhibit movement of the sheet into its operative position. Putting the fourth side in place requires that the fourth edge of the sheet be accurately received in the groove of the fourth side; also a very tedious job. When the fourth side is put into place, the artwork and backing member must be kept behind the spacers. Then, when the fourth side is in place, the artwork and backing members are manually forced forwardly against the spacers and leaf springs are put in place behind the backing member.

All of the foregoing steps take great manual dexterity and still the resulting assembly is not entirely satisfactory. The reason for this is that, using spacers bonded to the frame sides as described above, the spacers can come loose and sag due to gravity, thus leaving the artwork without proper front support. The spacers become separated from the frame sides because the leaf springs place the spacers in shear. Since fillet 10 is releasably retained on the sheet, it will not buckle or become separated from the sheet and this feature will assure that the artwork will be properly supported at all times.

Figure 8:
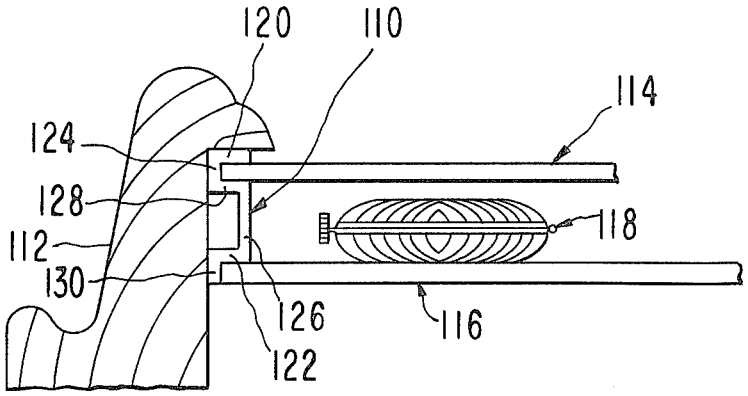
FIG. 8 is a view similar to FIGS. 2 and 3 but showing another embodiment of the fillet of this invention.

Another embodiment of the fillet of the present invention is broadly denoted by the numeral 110 and is shown in FIG. 8. Fillet 110 is to be used with a frame 112, a transparent glass or plastic sheet 114 and a backing panel 116 which mounts a piece of artwork in place. As shown in FIG. 8, the artwork is a pocket watch 118 but it is clear that the artwork could be a sheet of artwork as shown in FIGS. 2 and 3.

Fillet 110 has a plastic body comprised of end walls 120 and 122, a pair of spaced side walls 124 and 126 and an intermediate, connecting wall 128 interconnecting walls 124 and 126. A projecting wall 130 is integral with and projects downwardly from the outer end of wall 122. Walls 120, 122, 124, 126, 128 and 130 are integral with each other and are formed from a suitable material which can be molded or extruded. A typical material is polyethylene or butyrate. Any suitable material can be used so long as the walls of fillet 110 are relatively rigid, yet the fillet has resilience at least at the junctions of adjacent walls. Fillet 110 can be transparent or opaque if desired.

Walls 124 and 126 typically are parallel with each other but end wall 120 makes an acute angle with wall 128 so that these two walls form an open side recess whose width is effectively adjustable by virtue of the resilience of fillet 110 at the junction between walls 120 and 124. This adjustability permits end wall 120 to be biased toward and bear against sheet 114 whose outer peripheral edge margin is inserted into the corresponding recess formed between walls 120 and 128. Thus, the fillet can grip the edge margin of sheet 114 so as to be self-retaining on the sheet.

Typically, the recess between walls 128 and 122 is not used for receiving a sheet 114, such as when the fillet is reversed from the position shown in FIG. 8. Generally, the distance between walls 122 and 128 is about ½ inch, the typical spacing between sheet 114 and backing panel 116.

Projecting wall 130 provides a support against which the outer edge margin of backing panel 116 bears. This feature assures that fillet 110 will not buckle which it might otherwise do because of the relatively large width of wall 126.

Fillet 110 is, of course, S-shaped in cross-section and extends typically along the length of frame member 112. It mates in the same manner as that described above with respect to fillet 10 with other fillets as shown in FIG. 4.

What is claimed is:

1. A frame for artwork comprising: a number of frame members, the ends of the frame members being interconnected together to form an opening for viewing the artwork, each frame member having an overhang near the opening; a resilient fillet section for at least certain of said frame members, respectively, each fillet secton being transversely S-shaped and having a pair of spaced end walls and an intermediate wall to present a pair of recesses between the end walls and on opposite sides of the intermediate wall, each recess having an open side entrance the end walls being inclined toward the intermediate wall and the width of the side entrance of one recess being less than that of the other recess, one end wall of each fillet section being in engagement with the overhang of the respective frame member with the open side entrance of one of the recesses of each fillet section being adjacent to the opening in the frame; a transparent sheet across the opening, the outer peripheral edge margins of the sheet being removably received in the adjacent recesses of the fillet sections, the resilience of the material of each fillet section permitting each end wall thereof to yield away from the intermediate wall thereof when the adjacent edge margin of the transparent sheet extends into the corresponding recess and when the width of the entrance to the recess is normally less than the thickness of the sheet, whereby the sheet will be releasably gripped between the end wall and the intermediate wall of the fillet section and the fillet section will be releasably attached to the sheet; a sheet of artwork engaging the opposite end walls of the fillet sections, whereby the artwork is spaced from said sheet; a backing member behind the artwork sheet; and means securing the backing member to the frame members.

2. A device for use in mounting artwork in a frame having a transparent sheet spaced in front of the artwork comprising: an elongated, transversely S-shaped fillet of resilient, generally rigid, transparent material, said fillet adapted to be placed in an operative position at one side of the frame, the fillet having a pair of generally parallel side walls, each side wall having an outer end and an inner end, a pair of end walls integral with and extending laterally from the outer ends of respective side walls, and an intermediate wall integral at the ends thereof with the inner ends of respective side walls, each end wall being at an acute angle relative to the respective side wall and extending toward the intermediate wall as the free, outer end of the end wall is approached, the side walls being of different lengths, the side walls being on opposite sides of the fillet and on opposite sides of the intermediate wall to present a pair of open side recesses, the entrance to each recess being defined by the outer free end of an adjacent end wall and the adjacent end of the intermediate wall, the width of the entrance of one recess being less than that of the other recess, each recess being adapted to receive a side margin of a transparent sheet, the resilience of the material of said fillet permitting each end wall to yield away from the intermediate wall when the side margin of a transparent sheet extends into the corresponding recess and when the width of the entrance to the recess is normally less than the thickness of the sheet, whereby the sheet will be releasably gripped between the end wall and the intermediate wall and the fillet will be releasably attached to the sheet.

3. A device for use in mounting artwork in a frame having a transparent sheet spaced in front of the artwork comprising: an elongated, transversely S-shaped fillet of resilient, generally rigid material, said fillet adapted to be placed in an operative position at one side of the frame, the fillet having a pair of generally parallel side walls, each side wall having an outer end and an inner end, a pair of end walls integral with and extending laterally from the outer ends of thereof with the inner ends of respective side walls, one end wall being at an acute angle relative to the respective side wall and extending toward the intermediate wall as the free, outer end of the one end wall is approached, the side walls being of different lengths, the side walls being an opposite sides of the fillet and on opposite sides of the intermediate wall to present a pair of open side recesses, the entrance to the recess adjacent to said one end wall being defined by the outer free end of said one end wall and the adjacent end of the intermediate wall, the recess adjacent to said one end wall being adapted to receive a side margin of the transparent sheet, the angularity of said one end wall permitting the sheet to be releasably gripped between the intermediate wall and said one end wall when the end margin of the sheet extends into the corresponding recess, whereby the fillet will be releasably attached to the sheet, the other end wall having a side wall projecting outwardly from the outer end thereof substantially parallel with the side walls to engage a backing panel spaced rearwardly from the transparent sheet.

* * * * *